US009461432B2

(12) United States Patent
Takamura

(10) Patent No.: US 9,461,432 B2
(45) Date of Patent: Oct. 4, 2016

(54) CONNECTION TERMINAL

(71) Applicant: YAZAKI CORPORATION, Tokyo (JP)

(72) Inventor: Naoki Takamura, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/629,651

(22) Filed: Feb. 24, 2015

(65) Prior Publication Data

US 2015/0244132 A1 Aug. 27, 2015

(30) Foreign Application Priority Data

Feb. 25, 2014 (JP) ..... 2014-034491

(51) Int. Cl.

| | |
|---|---|
| ***H01R 13/11*** | (2006.01) |
| ***H01R 43/24*** | (2006.01) |
| ***H01R 4/48*** | (2006.01) |
| ***H01R 13/03*** | (2006.01) |
| ***H01R 13/115*** | (2006.01) |
| ***H01R 43/18*** | (2006.01) |

(52) U.S. Cl.

CPC ..... *H01R 43/24* (2013.01); *H01R 4/48* (2013.01); *H01R 13/03* (2013.01); *H01R 13/115* (2013.01); *H01R 43/18* (2013.01); *H01R 13/113* (2013.01)

(58) Field of Classification Search

CPC .... H01R 13/113; H01R 23/02; H01R 24/60; H01R 13/6275; H01R 13/6582; H01R 13/658; H01R 13/6585

USPC ..... 439/852, 752, 660

See application file for complete search history.

(56) References Cited

U.S. PATENT DOCUMENTS

| | | | | |
|---|---|---|---|---|
| 5,601,458 | A * | 2/1997 | Ohsumi | H01R 13/187 439/851 |
| 6,152,788 | A * | 11/2000 | Hata | H01R 13/113 439/51 |
| 6,264,509 | B1 * | 7/2001 | Kwang | H01R 13/113 439/852 |
| 6,804,122 | B1 * | 10/2004 | Wong | H01R 12/721 361/777 |
| 6,860,768 | B2 * | 3/2005 | Zhao | H01R 11/22 439/843 |
| 7,115,004 | B2 * | 10/2006 | Takayama | H01R 4/185 439/850 |
| 7,856,712 | B2 * | 12/2010 | Busies | H01R 13/113 29/874 |

(Continued)

FOREIGN PATENT DOCUMENTS

| | | |
|---|---|---|
| JP | 2000-243498 A | 9/2000 |
| JP | 2005-120475 A | 5/2005 |

*Primary Examiner* — Tho D Ta
*Assistant Examiner* — Thang Nguyen
(74) *Attorney, Agent, or Firm* — Sughrue Mion, PLLC

(57) ABSTRACT

A connection terminal includes a terminal main body which includes a bottom plate portion, a connecting spring portion integrally provided on one end side of the bottom plate portion, and a conductive connecting portion integrally provided on the other end side of the bottom plate portion; and a box portion which is integrally formed with the bottom plate portion from both edge portions of the bottom plate portion in a width direction of the connection terminal on the one end side by stereoscopic modeling and covers the connecting spring portion.

3 Claims, 8 Drawing Sheets

(56) References Cited

U.S. PATENT DOCUMENTS 7,918,695 B2 * 4/2011 Kutsuna ..... H01R 13/187 439/845
7,985,106 B2 * 7/2011 Sugiyama ..... H01R 13/113 439/852
8,684,769 B2 * 4/2014 Kao ..... H01R 13/6471 439/607.28
8,905,798 B2 * 12/2014 Amano ..... H01R 4/48 439/817
8,968,031 B2 * 3/2015 Simmel ..... H01R 13/659 439/108
9,022,800 B2 * 5/2015 Yang ..... H01R 13/6581 439/487
2005/0079086 A1 4/2005 Farr et al.
2008/0076274 A1 * 3/2008 Okuwaki ..... H05K 3/0005 439/65
2011/0151716 A1 * 6/2011 Kondo ..... H01R 13/6658 439/607.01
2011/0230076 A1 * 9/2011 Lim ..... H01R 9/032 439/345
2015/0004837 A1 * 1/2015 Brichard ..... H01R 24/30 439/607.41
2015/0079857 A1 * 3/2015 Kawamura ..... H01R 43/0482 439/877
2015/0126079 A1 * 5/2015 Kawamura ..... H01R 4/206 439/877
2015/0303621 A1 * 10/2015 Hsu ..... H01R 12/73 439/607.05

* cited by examiner

CONNECTION TERMINAL

CROSS REFERENCE TO RELATED APPLICATION

This application is based on Japanese Patent Application (No. 2014-034491) filed on Feb. 25, 2014, the contents of which are incorporated herein by reference. Also, all the references cited herein are incorporated as a whole.

BACKGROUND OF THE INVENTION

1. Technical Field

One or more embodiments of the present invention relate to a connection terminal.

2. Background Art

Examples of a connection terminal used in an electrical component of a vehicle include a box-type female terminal (see JP-A-2000-243498). According to the box-type female terminal (hereinafter, simply referred to as a "connection terminal") 501, an elastic tongue piece 503 which configures a terminal connecting portion and a circumferential wall 505 of a box type which surrounds the circumference of the elastic tongue piece 503 are integrally formed by performing a punching process and a folding process on a single metal plate as shown in FIG. 8. The elastic tongue piece 503 is formed by being folded toward the inside of the circumferential wall from the side of one opening end (upper end) of the circumferential wall 505 with the box shape so as to have a free end in the vicinity of the other opening end (lower end). The connection terminal 501 is used as a relay terminal for connecting male terminals such that a first male terminal 509 is inserted between the elastic tongue piece 503 and a front wall 507 of the circumferential wall 505 in the direction of the arrow P and a second male terminal 513 is inserted between the elastic tongue piece 503 and a back wall 511 of the circumferential wall 505 in the direction of the arrow Q.

However, the terminal connecting portion of the connection terminal 501 with such a configuration is configured of a single metal plate, and therefore, there is a coupling portion 515 between edges of the metal plate in a part of the circumferential wall 505 in the circumferential direction, and the circumferential wall 505 discontinuously extends at the coupling portion 515. For this reason, the strength of the circumferential wall 505 is low, and when the male terminal 509 and the male terminal 513 are inserted thereinto and the male terminal 509 and the male terminal 513 are twisted, in particular, there is a possibility in that the connection terminal 501 is deformed (opened) in a direction in which the coupling portion 515 of the circumferential wall 505 is opened and original contact pressure cannot be held.

Thus, according to the connection terminal 501, locking projections 517 each of which has a tip end which is wider than a root thereof are formed at an edge of the front wall 507 which configures the coupling portion 515 of the circumferential wall 505, and widened notch portions 521 each of which is formed to be fitted into the locking projection 517 at an edge of a side wall 519. With such a configuration, the locking projection 517 is fitted into the notch portion 521, and deformation of the circumferential wall 505 is prevented.

Patent document 1 is JP-A-2000-243498.

SUMMARY OF THE INVENTION

However, since the locking projection 517 formed in the metal plate is fitted into the widened notch portion 521 formed in the side wall 519 in the aforementioned connection terminal 501 in the related art, it becomes difficult to establish the locking projection 517 if the size of the connection terminal 501 is significantly reduced. That is, if the thickness of the metal plate is reduced, the fitting between the locking projection 517 and the notch portion 521 tends to be loosened. If the fitting between the locking projection 517 and the notch portion 521 is loosened, there is a possibility that the box portion will be opened due to reaction force generated when the male terminal 509 and the male terminal 513 are inserted and connection reliability of the terminal connecting portion deteriorates.

The present invention was made in view of the aforementioned circumstances, and one of objects of the invention is to provide a connection terminal capable of improving connection reliability without causing opening of a box portion.

The object of the invention described above is achieved by the following configurations.

(1) A connection terminal including: a terminal main body which includes a bottom plate portion, a connecting spring portion integrally provided on one end side of the bottom plate portion, and a conductive connecting portion integrally provided on the other end side of the bottom plate portion; and a box portion which is integrally formed with the bottom plate portion from both edge portions of the bottom plate portion in a width direction of the connection terminal on the one end side by stereoscopic modeling and covers the connecting spring portion.

According to the connection terminal with the configuration (1), the connecting spring portion is integrally formed on the one end side of the bottom plate portion in the terminal main body. The terminal main body can be formed by performing a punching process and a folding process on a single metal plate.

The connecting portion of the box portion, which is formed by stereoscopic modeling, to be connected to the bottom plate portion made of the metal plate is melted and is then bonded thereto.

The box portion formed by stereoscopic modeling from the both edge portions of the bottom plate portion in the direction of the terminal width is formed to have a tubular shape which covers the connecting spring portion. That is, the terminal connecting portion into which the counterpart terminal is inserted has a seamless closed tubular cross-sectional shape. If the counterpart terminal is inserted into the box portion, the connecting spring portion is elastically deformed by the counterpart terminal. The counterpart terminal presses the box portion from the inside thereof by a reaction force of the elastically deformed connecting spring portion. Since the box portion is seamless, the box is not opened due to the reaction force.

According to stereoscopic modeling such as a powder sintering lamination modeling method, it is possible to realize forming accuracy of ±0.1 mm even with the current technology. For this reason, it is possible to form a small connection terminal which cannot be easily formed by a general punching process and a folding process and to thereby further miniaturize the connection terminal.

(2) The connection terminal according to (1), wherein the terminal main body is formed by stereoscopic modeling.

According to the connection terminal with the configuration (2), the terminal main body configured of the bottom plate portion, the connecting spring portion, and the conductive connecting portion are integrally formed by stereoscopic modeling. That is, all the components of the terminal main body and the box portion in the connection terminal are formed by stereoscopic modeling. According to the connection terminal with the components which are entirely formed by stereoscopic modeling, it is not necessary to perform the punching process and the folding process and to manage supply of members formed by these processes. As a result, it is possible to simplify the manufacturing process.

(3) The connection terminal according to (2), wherein the bottom plate portion and the connecting spring portion are formed from different metal materials.

According to the connection terminal with the configuration (3), it is possible to form the connecting spring portion as a portion with a particularly excellent spring property by differing the metal material as a powder material between the bottom plate portion and the connecting spring portion when the terminal main body is formed by stereoscopic modeling such as the powder sintering lamination modeling method. Accordingly, it is possible to enhance the connecting performance of the connecting spring portion, the connecting performance of the conductive connecting portion, and the like as compared with a general connection terminal with components which are formed from a single material.

According to the connection terminal of the embodiments of the present invention, it is possible to improve connection reliability without causing opening of a box portion to occur.

The brief description was given of the present invention hitherto. Details of the present invention will be further clearly understood by thoroughly reading the following embodiment of implementing the invention (hereinafter, referred to as an "embodiment") with reference to accompanying drawings.

DETAILED DESCRIPTION OF THE EXEMPLARY EMBODIMENTS

Hereinafter, a description will be given of an embodiment of the present invention with reference to drawings.

Figure 1:
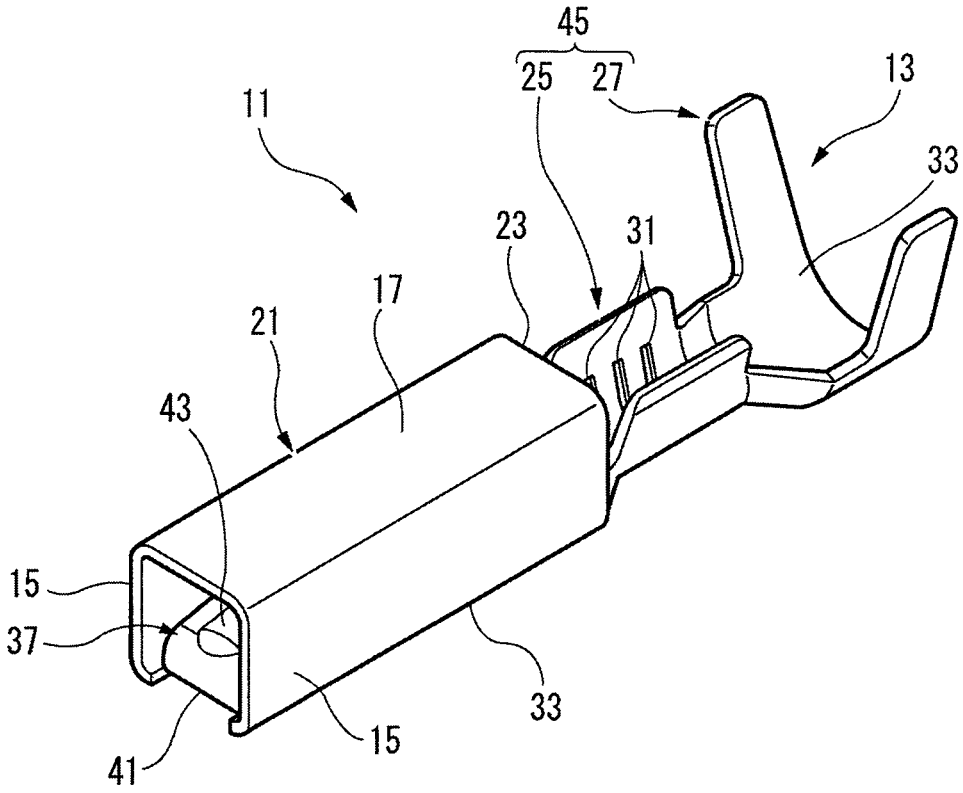
FIG. 1 is a perspective view of a connection terminal according to an embodiment of the present invention.

A connection terminal 11 according to an embodiment of the present invention is configured of conductive metal and is installed in and used with a connector housing (not shown), for example. In the connection terminal 11, a box portion 21, a conductive crimp portion 25, and an insulated sheath crimp portion 27 are successively provided from the tip end side thereof as shown in FIG. 1. The box portion 21 is a terminal connecting portion which receives a tab-shaped electrical contact portion 29 of a male terminal (counterpart terminal) 19 and is connected to have electrical continuity with the male terminal 19. That is, the connection terminal 11 according to the embodiment is a female terminal.

A lance locking portion 23 provided at the back end of the box portion 21 is locked by a lance formed at a connector housing from the back side when the connection terminal 11 advances into a terminal accommodation chamber in the connector housing. With such a configuration, pulling out of the connection terminal 11 from the terminal accommodation chamber is restricted. In addition, the box portion 21 may be provided with a spacer abutting portion (not shown). A secondary locking portion formed at a spacer abuts the spacer abutting portion when the spacer (not shown) is installed in the connector housing.

The conductive crimp portion 25 is crimped to a conductive body of an electrical wire (not shown) from which an insulated sheath is removed. A serration 31 which is a saw-tooth-shaped indentation is formed in the conductive crimp portion 25. The serration 31 can remove an oxidized cover formed by oxidation of the surface of the conductive body in digging into the conductive body. To the insulated sheath crimp portion 27, an electrical wire is crimped from the outer circumference of the insulated sheath. The connection terminal 11 is fixed to the electrical wire by the conductive crimp portion 25 and the insulated sheath crimp portion 27.

Incidentally, the connection terminal 11 according to the embodiment can be roughly classified into the terminal main body 13 and the box portion 21.

Figure 2:
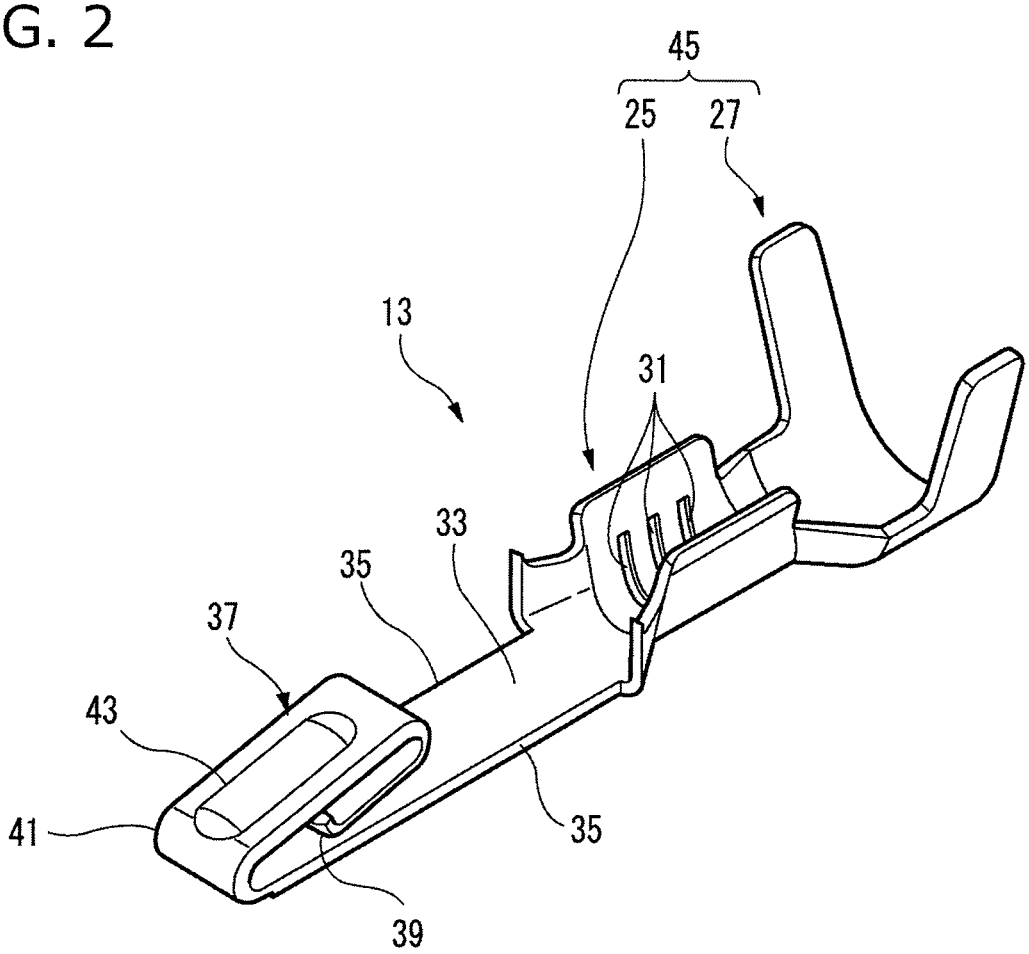
FIG. 2 is a perspective view of a terminal main body shown in FIG. 1.

A connecting spring portion 37 is integrally provided on the upper surface of the terminal main body 13 on one end side (the left side in the drawing) of the bottom plate portion 33 in a direction along both edges 35 as shown in FIG. 2. The connecting spring portion 37 includes a tip end portion 39 as a free end and a base end portion 41 which is integrally formed with the bottom plate portion 33. An indentation 43 is provided so as to project from the connecting spring portion 37. An increase in electrical resistance caused by insulating powder and the like interposed between the connecting spring portion 37 and the male terminal 19 is suppressed by the connecting spring portion 37 being brought into contact with the male terminal 19 via the indentation 43, and the connecting spring portion 37 can continuously establish electrical contact. In addition, the connecting spring portion according to the present invention can have a configuration of being embedded in the box portion after being formed as a separate body from the terminal main body.

On the other end side (the right side in the drawing) of the terminal main body 13, a conductive connecting portion 45 is integrally formed. The conductive connecting portion according to the embodiment is configured of the aforementioned conductive crimp portion 25 and the insulated sheath crimp portion 27. In addition, the conductive connecting portion 45 may be formed as a lead portion in a case in which the connection terminal 11 is mounted on a wiring substrate or the like. The terminal main body 13 can be formed by performing a punching process and a folding process on a single metal plate. In addition, the terminal main body 13 may be formed by integrally molding the connecting spring portion 37 and the conductive connecting portion 45 by stereoscopic modeling with the bottom plate portion 33 formed from a metal plate.

The box portion 21 according to the embodiment includes a pair of side plate portions 15 which are integrally formed with the bottom plate portion 33 by stereoscopic modeling so as to erect from both edges 35 of the bottom plate portion 33 and a top plate portion 17 which is integrally formed by the stereoscopic modeling so as to connect upper edges of the pair of side plate portions 15.

Here, as the stereoscopic modeling, it is possible to employ the powder sintering lamination modeling method, for example. In the powder sintering lamination modeling method, a material is formed into a desired shape by sequentially melting, sintering, and laminating metal and resin powder with a laser heat source unlike in a powder fixing lamination method in which a binder is applied to material powder and the material powder particles are made to adhere to each other and are then laminated. While materials to be formed are limited according to the lamination modeling method used, a representative example of which is an optical modeling method, it is possible to mold various materials such as a resin material, metal, and ceramics according to the powder sintering lamination modeling method.

Figure 3:
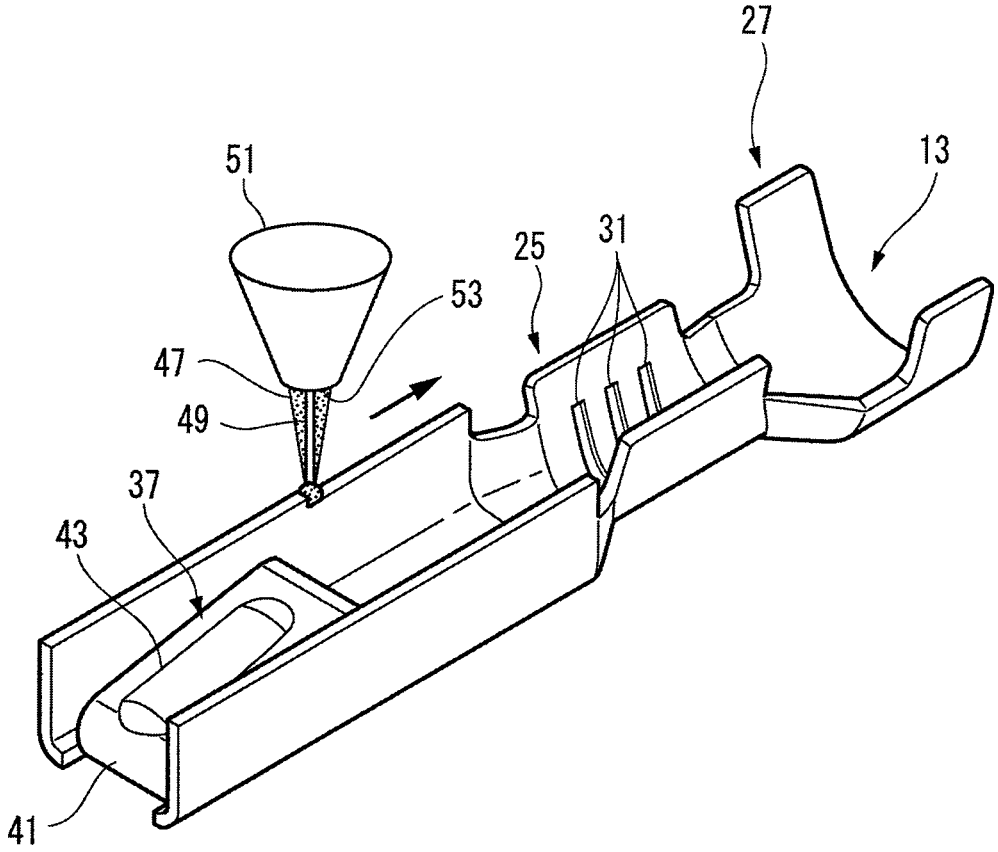
FIG. 3 is a manufacturing process diagram showing a process of molding a box portion.

According to the powder sintering lamination modeling method, metal powder 47 is laminated while being melted by a laser heat source in a molding chamber as shown in FIG. 3. The molding chamber is provided with an IR heater as a heat source. According to the powder sintering lamination modeling method, internal stress is generated between layers if the material melted by laser irradiation 49 is rapidly cooled immediately after fusion with a previously formed layer. Thus, it is possible to suppress rapid cooling and to thereby prevent generation of the internal stress by raising the temperature of the molding environment up to a temperature that is close to a melting temperature of the material to be formed by using the IR heater. In addition, a nitrogen atmosphere is employed in the molding chamber in order to prevent burning and oxidation.

As a laser mounted on a head 51, a $CO_2$ laser or a YAG laser is used. In addition, the head 51 is provided with a nozzle 53 for supplying a material. Operations of the head 51 are controlled based on 3DCAD data. Simultaneous multiaxial control is performed on the head 51 in the same manner as main shafts of working machines. According to the powder sintering lamination modeling method, it is possible to generate metal layers with fine pitches regardless of the shape of the modeled surface by constantly monitoring and controlling the laser irradiation amount, the material supply amount, and the like.

According to the powder sintering lamination modeling method, it is also possible to perform hybrid modeling by using powder metal for general industrial use instead of expensive dedicated alloy. It is possible not only to model all the components from a base material (terminal main body 13) but also to model the box portion 21 in addition to the terminal main body 13. It is a matter of course that the connection terminal 11 can be entirely formed by the stereoscopic modeling. At this time, the shape of the base material (terminal main body 13) is not limited to a planar shape. The surface of the base material (terminal main body 13) to be additionally modeled may be a three-dimensional free curved surface. That is, the connecting spring portion 37 and the like may be previously formed.

According to the powder sintering lamination modeling method, metal such as titanium, stainless steel, nickel alloy, Inconel (registered trademark), aluminum, copper, or tin can be used. In addition, a material such as engineering plastic, ceramics, or sand can be selected in accordance with the purpose of usage.

As the stereoscopic modeling for manufacturing a metal formed article by using metal powder, it is possible to employ a method of manufacturing a three-dimensional metal article (see JP-A-2005-120475) including: a step of depositing a particle mixture containing a plurality of metal particles or metal alloy particles and peroxide in a limited region; and a step of selectively ejecting a binder onto a predetermined area of the particle mixture by an ink jet scheme in order to form an unprocessed portion.

Figure 4A:
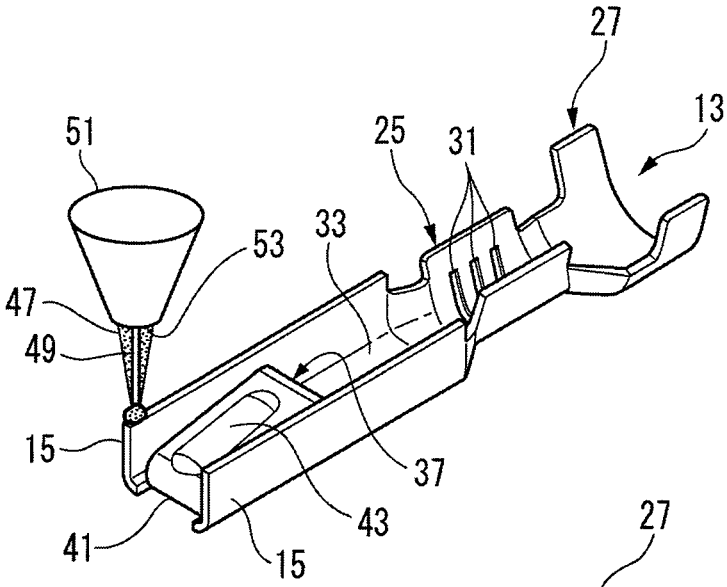
FIG. 4A is a manufacturing process diagram in the course of molding of a side plate portion of the box portion.
Figure 4B:
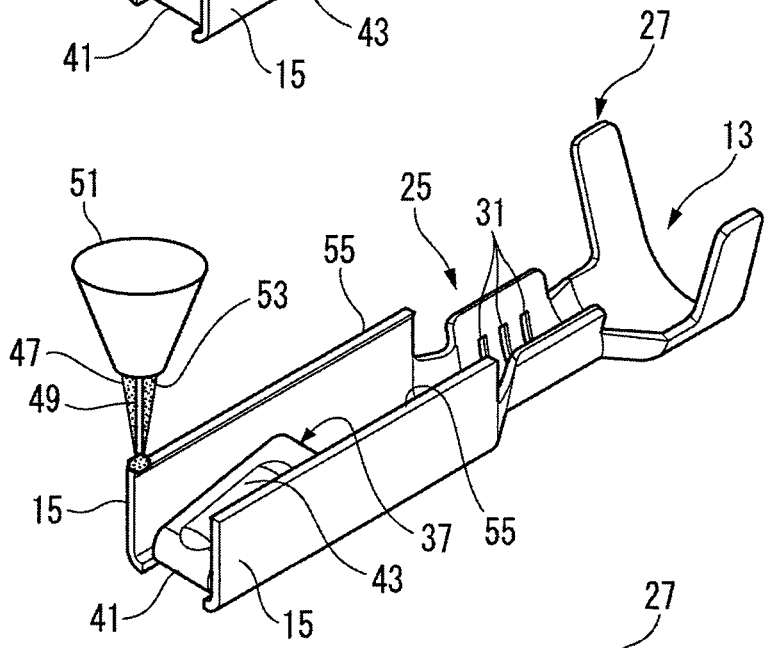
FIG. 4B is a manufacturing process diagram showing a state in which the molding of the side plate portion has been completed.
Figure 4C:
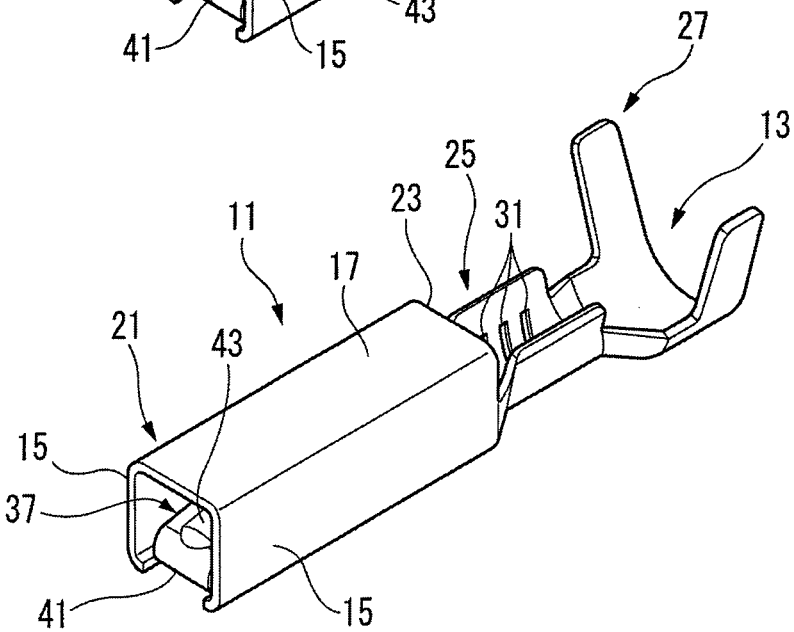
FIG. 4C is a manufacturing process diagram showing a state in which molding of a top plate portion of the box portion has been completed.
Figure 5:
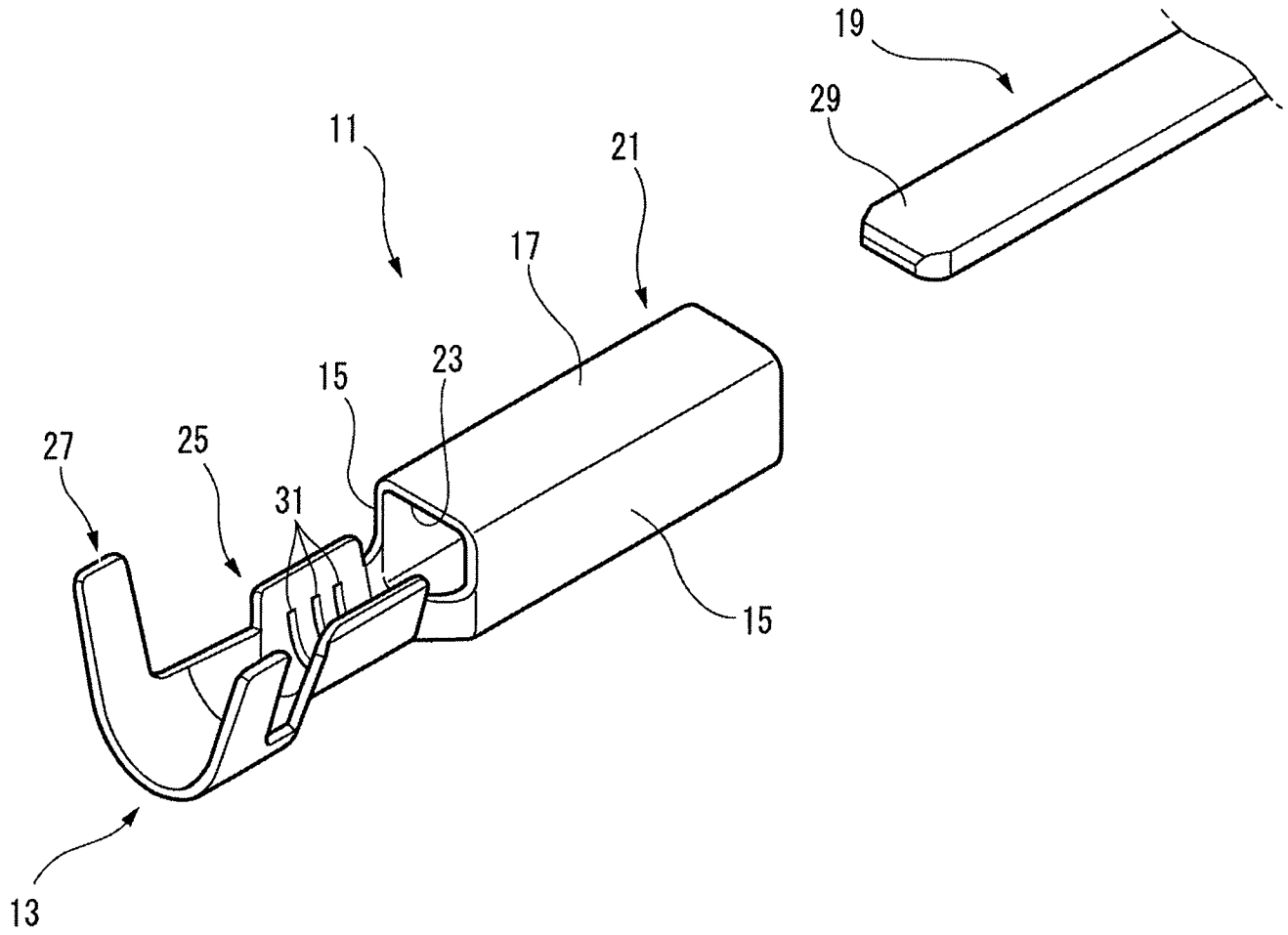
FIG. 5 is a perspective view immediately before a counterpart terminal is inserted into the connection terminal shown in FIG. 1.

According to the connection terminal 11 of the embodiment, the pair of side plate portions 15 are formed on both the edges 35 of the bottom plate portion 33 as shown in FIGS. 4A and 4B by aforementioned powder sintering lamination modeling method, and the top plate portion 17 as shown in FIG. 4C is then modeled. That is, the top plate portion 17 is integrally formed with the pair of side plate portions 15 so as to connect the upper edges 55 of the pair of side plate portions 15 by the three-dimensional molding.

According to the connection terminal 11 of the embodiment, the terminal main body 13 may be formed by stereoscopic modeling. In such a case, all components of the terminal main body 13 and the box portion 21 in the connection terminal 11 are formed by stereoscopic modeling.

In a case of the configuration in which the terminal main body 13 of the connection terminal 11 is formed by stereoscopic modeling as described above, the bottom plate portion 33, the connecting spring portion 37, and the conductive connecting portion 45 can be formed from different kinds of metal.

Next, a description will be given of operations of the connection terminal 11 with the aforementioned configuration.

According to the connection terminal 11 of the embodiment, the connecting spring portion 37 is integrally formed on the upper surface of the terminal main body 13 on one end side of the bottom plate portion 33. The terminal main body 13 can be formed by performing the punching process and the folding process on a single metal plate. In the case in which the terminal main body 13 is formed by performing the punching process and the folding process on the metal plate as described above, the connection terminal 11 is additionally modeled (so-called hybrid modeling).

The connecting portion of the box portion 21 formed by stereoscopic modeling such as the powder sintering lamination modeling method, which is to be connected to the bottom plate portion 33 made of a metal plate, is melted and bonded. The metal material used in the stereoscopic modeling of the side plate portions 15 and the top plate portion 17 in the box portion 21 is the same as that for the bottom plate portion 33.

In addition, colors of the side plate portions 15 and the top plate portion 17 in the box portion 21, which correspond to a modeled portion formed by the stereoscopic modeling, are substantially the same as the color of the terminal main body 13. Moreover, the box portion 21 can be formed as a highly precise integrally formed article, in which the additionally formed portion cannot be visually recognized, if post-processing is performed thereon.

Figure 6:
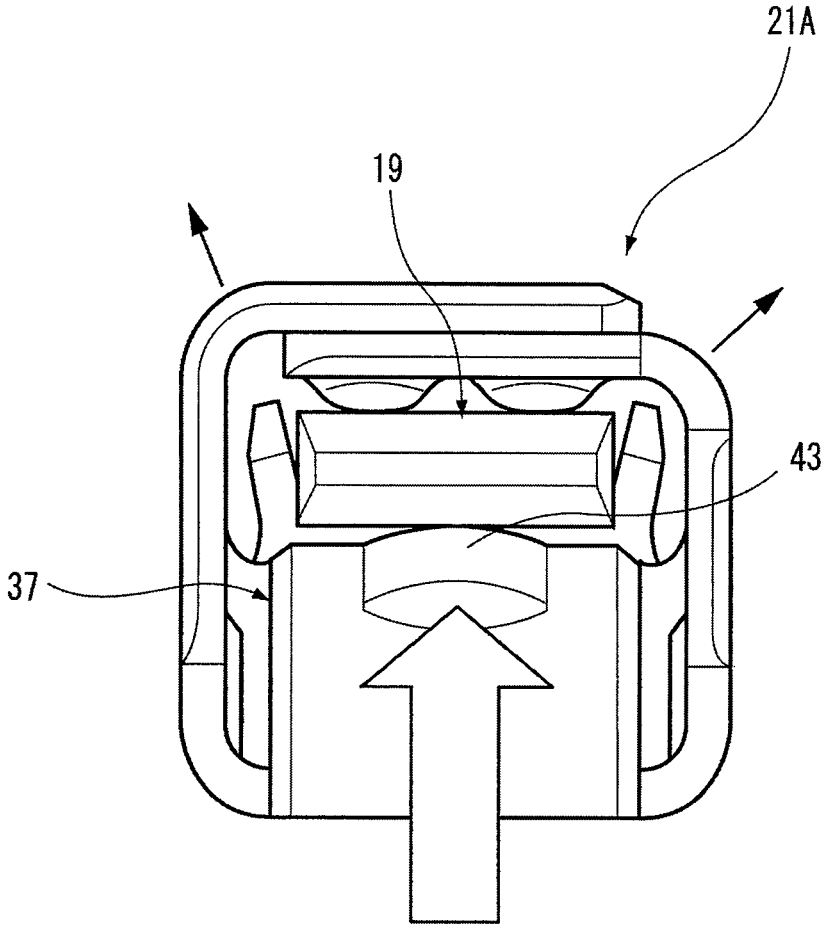
FIG. 6 is a front view of a connection terminal according to a comparative example in which a counterpart terminal is inserted into a box portion with a coupling portion that is formed by a punching process and a folding process.

As in the comparative example shown in FIG. 6, the box portion 21*a* formed by the punching process and the folding process have a seamed structure in which the top plate portions are overlapped in the vertical direction. In the case of the connection terminal being provided with such a box portion 21A, the connecting spring portion 37 is elastically deformed by the male terminal 19 when the male terminal 19 is inserted into the box portion 21A. The male terminal 19 presses the box portion 21A from the inside thereof by a reaction force of the elastically deformed connecting spring portion 37, and there is a possibility that the seamed portion of the box portion 21A will be separated due to the reaction force and the box will be opened.

Figure 7:
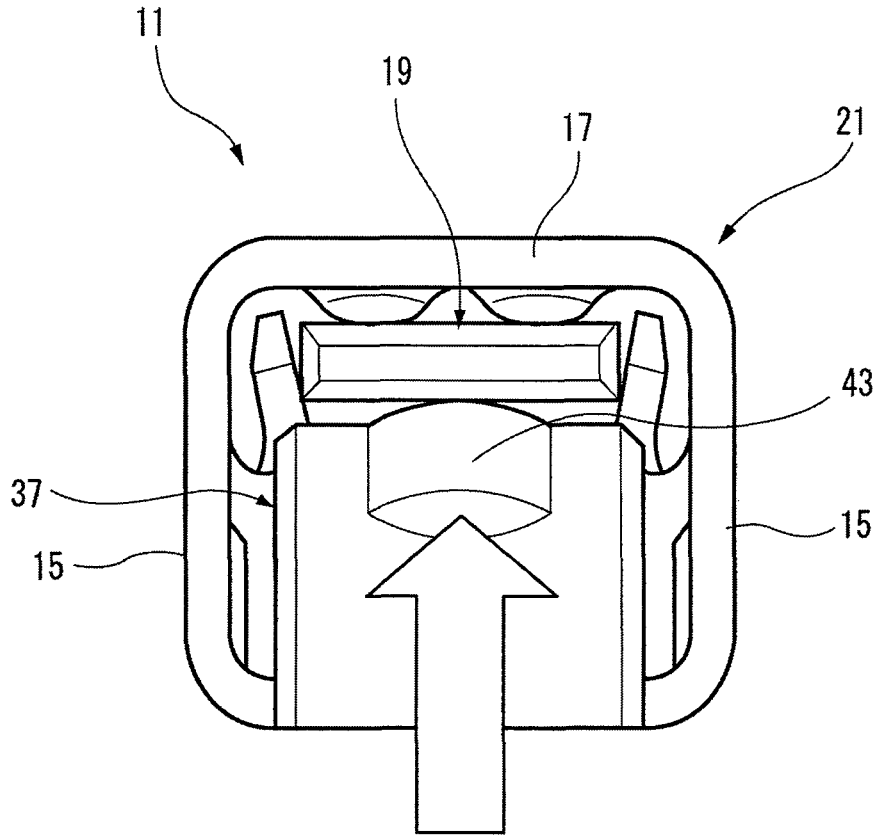
FIG. 7 is a front view of a connection terminal according to the embodiment in which the counterpart terminal is inserted into a seamless box portion formed by stereoscopic modeling.
Figure 8:
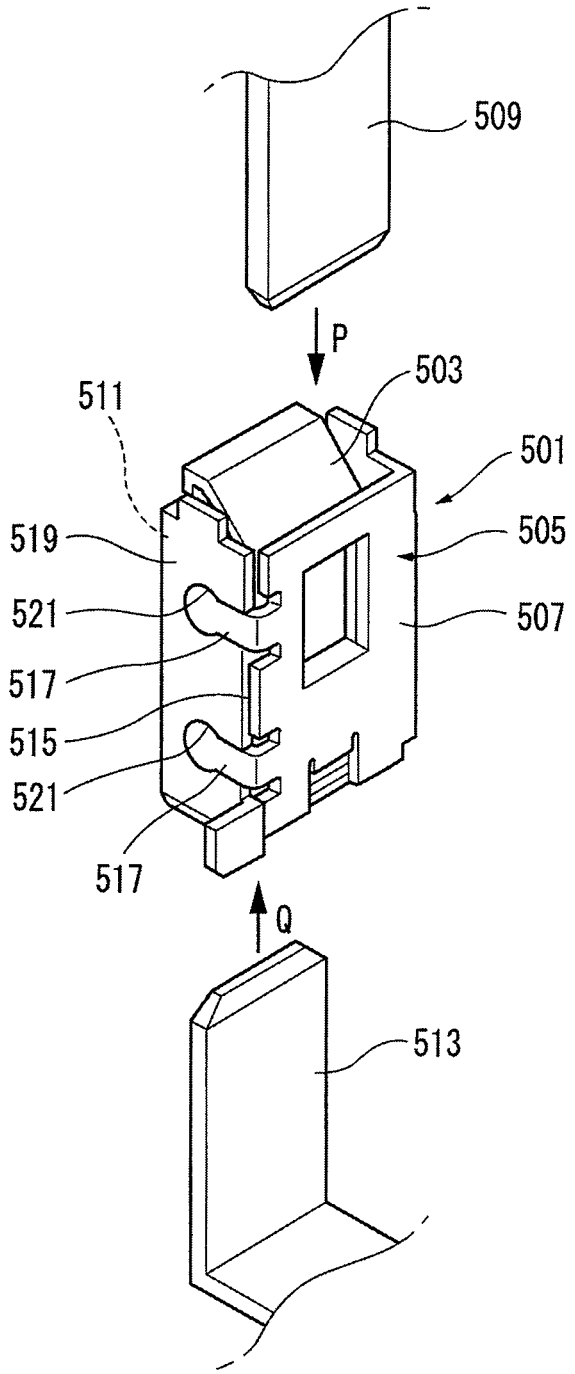
FIG. 8 PRIOR ART
FIG. 8 is a perspective view showing a connection terminal with a box portion in the related art along with male terminals.

In contrast, the box portion 21 of the connection terminal 11 which is formed by the stereoscopic modeling from both the edges 35 of the bottom plate portion 33 in the direction of the terminal width is formed into a square tubular shape so as to cover the connecting spring portion 37 as shown in FIG. 7. That is, the box portion 21 as the terminal connecting portion into which the male terminal 19 is inserted has a seamless closed rectangular ring cross-sectional shape. If the male terminal 19 is inserted into the box portion 21, the connecting spring portion 37 is elastically deformed by the male terminal 19. The male terminal 19 presses the box portion 21 from the inside thereof due to the reaction force of the elastically deformed connecting spring portion 37. Since the box portion 21 is seamless, the box is not opened due to the reaction force.

Using the aforementioned stereoscopic modeling such as the powder sintering lamination modeling method, it is possible to realize molding accuracy of ±0.1 mm with current technology. For this reason, it is possible to form a small connection terminal 11 which cannot be easily formed by a general punching process and a folding process and to thereby further miniaturize the connection terminal 11.

According to the connection terminal 11 of the embodiment, the terminal main body 13 configured of the bottom plate portion 33, the connecting spring portion 37, and the conductive connecting portion 45 can be integrally formed by stereoscopic modeling. In such a case, all the components of the terminal main body 13, the side plate portions 15 and the bottom plate portions 33 in the connection terminal 11 are formed by stereoscopic modeling. According to the connection terminal 11 with components which are all formed by stereoscopic modeling, it is not necessary to perform the punching process and the folding process and to manage supply of members formed by these processes, and therefore, it becomes possible to simplify the manufacturing process.

According to the connection terminal 11 of the embodiment, it is possible to mold the connecting spring portion 37 as a portion with a particularly excellent spring property by replacing the metal material as a power material with the bottom plate portion 33 and the connecting spring portion 37 when the terminal main body 13 is formed by stereoscopic modeling such as the powder sintering lamination modeling method.

Examples of a powder material which causes the excellent spring property to be exhibited in the connecting spring portion 37, phosphor bronze and beryllium copper. In such a case, it is possible to use brass, for example, for the box portion 21 and the conductive connecting portion 45 as other components. In so doing, it is possible to enhance the connecting performance of the connecting spring portion 37, the pressure-bonding performance of the conductive connecting portion 45 (in a case in which the conductive connecting portion 45 is a crimp portion), and the like as compared with a general connection terminal 11 with components which are formed from a single material.

Therefore, according to the connection terminal 11 of the embodiment, it is possible to improve the connection reliability without causing opening of the box portion 21 as the terminal connecting portion.

Here, the respective features of the aforementioned embodiment of the connection terminal according to the present invention will be briefly described below.

[1] A connection terminal 11 including:

a terminal main body 13 which includes a bottom plate portion 33, a connecting spring portion 37 integrally provided on one end side of the bottom plate portion 33, and a conductive connecting portion 45 integrally provided on the other end side of the bottom plate portion 33; and a box portion 21 which is integrally formed with the bottom plate portion 33 from both edge portions 35 of the bottom plate portion 33 in the width direction of the connection terminal 11 on the one end side by stereoscopic modeling and covers the connecting spring portion 37.

[2] The connection terminal 11 according to [1], wherein the terminal main body 13 is formed by stereoscopic modeling.

[3] The connection terminal 11 according to [2], wherein the bottom plate portion 33 and the connecting spring portion 37 are formed from different metal materials.

The present invention is not limited to the aforementioned embodiment, and modifications, amendments, improvements, and the like can be appropriately made thereto. In addition, materials, shapes, dimensions, numbers, arrangement positions, and the like of the respective components in the aforementioned embodiment are arbitrarily selected and are not limited to those described in the embodiment.

Although the box portion 21 which covers the connecting spring portion 37 is formed into a square tubular shape in the connection terminal 11 according to the embodiment, it is a matter of course that various shapes such as a cylindrical shape can be employed, for example.

Although the conductive connecting portion 45 according to the embodiment is configured of the pair of conductive crimp portions 25 and the pair of insulated sheath crimp portions 27, which are spread crimp pieces, the conductive connecting portion 45 may be configured as a lead portion which is soldered to a wiring substrate or a bus bar.

What is claimed is:

1. A connection terminal comprising:

a terminal main body which includes a bottom plate portion, a connecting spring portion integrally provided on one end side of the bottom plate portion, and a conductive connecting portion integrally provided on the other end side of the bottom plate portion; and a box portion which is integrally formed with the bottom plate portion from both edge portions of the bottom plate portion in a width direction of the connection terminal on the one end side by stereoscopic modeling and covers the connecting spring portion, wherein the box portion is seamless and formed as an integrally formed article with the bottom plate portion.

2. The connection terminal according to claim 1, wherein the terminal main body is formed by stereoscopic modeling.

3. The connection terminal according to claim 2, wherein the bottom plate portion and the connecting spring portion are formed from different metal materials.

* * * * *